US010750835B2

(12) United States Patent
Santacoloma Moro

(10) Patent No.: US 10,750,835 B2
(45) Date of Patent: Aug. 25, 2020

(54) PORTABLE, WATERIGHT SEALING DEVICE AND METHOD FOR USE OF THE DEVICE

(71) Applicant: Juan Francisco Santacoloma Moro, Derio (ES)

(72) Inventor: Juan Francisco Santacoloma Moro, Derio (ES)

( * ) Notice: Subject to any disclaimer, the term of this patent is extended or adjusted under 35 U.S.C. 154(b) by 0 days.

(21) Appl. No.: 16/397,425

(22) Filed: Apr. 29, 2019

(65) Prior Publication Data

US 2019/0328096 A1 Oct. 31, 2019

(30) Foreign Application Priority Data

Apr. 30, 2018 (ES) ..... 201800269 U

(51) Int. Cl.

| | |
|---|---|
| ***A45C 11/22*** | (2006.01) |
| ***B65D 33/16*** | (2006.01) |
| ***A45F 5/02*** | (2006.01) |
| ***A45F 3/00*** | (2006.01) |
| ***A45C 13/00*** | (2006.01) |

(52) U.S. Cl.

CPC ..... *A45C 11/22* (2013.01); *A45C 13/008* (2013.01); *A45F 3/00* (2013.01); *A45F 5/02* (2013.01); *A45F 2003/002* (2013.01); *A45F 2003/006* (2013.01); *B65D 33/1616* (2013.01); *B65D 33/1633* (2013.01)

(58) Field of Classification Search

CPC ..... A45C 11/22; A45C 13/008; A45F 5/02; A45F 2005/006; B65D 33/16; B65D 33/1616; B65D 33/1633

USPC ..... 206/811; D3/303; 224/235, 934; 383/70, 71

See application file for complete search history.

(56) References Cited

U.S. PATENT DOCUMENTS

| | | | | | |
|---|---|---|---|---|---|
| 1,204,068 | A | * | 11/1916 | Robin et al. | B65D 33/06 383/25 |
| 1,566,867 | A | * | 12/1925 | Kohlhof | A45C 1/04 383/6 |
| 1,573,590 | A | * | 2/1926 | Wallace | A45C 11/22 383/3 |
| 1,671,385 | A | * | 5/1928 | Strayer | A45C 11/22 383/68 |
| 1,942,246 | A | * | 1/1934 | Johaneson | A45C 11/22 383/69 |
| 2,036,687 | A | * | 4/1936 | Fisher | A45C 11/22 383/70 |

(Continued)

FOREIGN PATENT DOCUMENTS

| | | | | |
|---|---|---|---|---|
| GB | 2574932 | A * | 12/2019 | A45F 5/022 |

*Primary Examiner* — Justin M Larson

(74) *Attorney, Agent, or Firm* — Gardner Linn

(57) ABSTRACT

The present invention provides a portable, watertight sealing device and a method for use of the device. The device allows keeping and moving small objects safely and in a watertight manner, the sealing device including a bag made of a deformable and waterproof elastic material, in turn having a main body, a neck, and an opening through which an object can be inserted; and a main ring likewise made of a deformable and waterproof elastic material, and having a central hole. In the sealed position of the device, the neck of the bag has a fold in a position inserted into the central hole of the main ring, with a band retained between the fold on the neck and the main ring.

14 Claims, 5 Drawing Sheets

(56) References Cited

U.S. PATENT DOCUMENTS

| | | | | | |
|---|---|---|---|---|---|
| 2,107,692 | A * | 2/1938 | De Botelho | B65D 33/1616 | 383/62 |
| 3,036,506 | A * | 5/1962 | Andresen, Jr. | G03B 17/08 | 396/27 |
| 5,517,729 | A * | 5/1996 | Shaffer | B65D 33/1616 | 24/115 R |
| 5,618,105 | A * | 4/1997 | Baker | A61C 9/0026 | 206/221 |
| 5,639,164 | A * | 6/1997 | Ishino | B65D 90/046 | 220/1.5 |
| 5,645,205 | A * | 7/1997 | Kennedy | A45C 11/22 | 224/676 |
| 5,878,441 | A * | 3/1999 | Busker | A41D 27/201 | 2/247 |
| 5,979,744 | A * | 11/1999 | Brigleb | B65D 67/00 | 150/154 |
| 6,435,392 | B1 * | 8/2002 | Kennedy | A45C 11/22 | 224/277 |
| D489,180 | S * | 5/2004 | Kramer | D3/303 | |
| D584,054 | S * | 1/2009 | Massie | D3/244 | |
| D588,812 | S * | 3/2009 | Springston | D3/202 | |
| 7,878,380 | B2 * | 2/2011 | Bass | A45F 5/102 | 224/600 |
| 8,925,158 | B2 * | 1/2015 | Fried | B65D 33/1633 | 24/115 G |
| 8,931,242 | B1 * | 1/2015 | Sardo | B65B 51/04 | 383/121 |
| 2019/0328096 | A1 * | 10/2019 | Santacoloma Moro | A45F 5/022 | |

* cited by examiner

PORTABLE, WATERIGHT SEALING DEVICE AND METHOD FOR USE OF THE DEVICE

FIELD OF THE INVENTION

The present invention relates to containers for storing and/or transporting objects, and more specifically bags, pouches, or the like.

BACKGROUND OF THE INVENTION

Users who practice water and underwater sports, such as swimming, snorkeling, diving, surfing, windsurfing, kitesurfing, etc., are growing in number today.

Generally, while performing these sports activities either indoors or outdoors, users must keep and protect certain personal objects from contact with water to prevent the objects from breaking or being misplaced, for example: watches, car keys, mobile telephones, or any other type of object that may sustain damage.

In this sense, different solutions that are more or less watertight for keeping objects therein and thereby preventing them from getting wet, such as cases, small bottles, or covers with hermetic seals, for example, are known in the state of the art. However, these current solutions continue to have several drawbacks among which at least the following stand out:

- They do not adapt to the size of the kept objects, so the object can move freely therein, hit against them, and/or break their inner walls, thereby leading to the kept object coming out and being misplaced;
- They have very bulky or rigid casings, lids, or shells, making the transport thereof a nuisance while practicing sports, where they may furthermore cause injuries of a certain severity to the actual athlete;
- They incorporate complex opening and sealing mechanisms with a plurality of parts or fixing elements, which in addition to increasing the possibilities of operational failures, breakages, and defects, require more of the athlete's time, furthermore involving higher product manufacturing costs.

SUMMARY OF THE INVENTION

The present invention provides a portable, watertight sealing device that can be used, in particular, for practicing water or underwater sports, whereby it is possible to keep and move small objects safely and in a watertight manner, without having to resort to complex opening and sealing mechanisms, keeping the kept objects completely dry, protected and isolated from the outside as a result of it being hermetic. Moreover, there is provided a method for use of the sealing device, as will be explained below.

According to one form of the invention, the sealing device comprises a bag made of a deformable and waterproof elastic material, such as rubber, polyurethane, or silicone, in turn comprising a main body, a neck, and an opening through which an object can be inserted; and a main ring likewise made of a deformable and waterproof elastic material, such as silicone, and having a central hole; such that in the sealed position of the device, the neck of the bag has a fold in a position inserted into the central hole of the main ring, with a band being retained between the fold of the neck and the main ring.

The sealing device therefore allows adaptation to the size of the objects to be kept, is very easy to use, and furthermore has certain buoyancy, such that in the event of the device falling into or being lost in the water, it would not sink, but rather float on the surface of the water.

In one aspect, the opening has gripping element or holding means to favor gripping the bag which, according to a possible embodiment of the invention, comprise at least one protuberance arranged in the proximities of the upper edge of the opening, parallel to the edge. These holding means not only facilitate the gripping and handling of the sealing device, preventing it from slipping, but also act as a stop element for the main ring.

In another aspect, the neck of the bag is narrower than the main body and the opening. This is not a trivial or random feature, rather it aims to achieve two well identified objectives:

- preventing the object housed inside the main body from readily coming out of the body since the lower walls of the neck act as a barrier; and
- constituting an additional safety element, preventing the main ring from coming loose or out in the final sealed position.

According to another form of the invention, a method for use of the aforementioned sealing device is described below, the method comprising the following steps:

a) inserting the object for keeping into the bag;

b) joining the two ends of the band to form a loop;

c) inserting the loop of the band into the central hole of the ring;

d) passing the loop of the band around the neck of the bag;

e) making a fold of the neck of the bag retaining the loop of the band;

f) sliding the ring towards the neck of the bag; and g) pulling the band until the fold of the neck goes through the central hole of the ring, with the band being retained between the fold of the neck and the main ring itself.

It should be understood that when mention is made in the present application to the term "loop," it refers herein to a noose or closed tie segment, i.e., the loop is formed by the band segment created by joining the two ends thereof by means of a knot or the like.

Moreover, it has been envisaged that step b) is not required if the band is a strap incorporated in the actual clothing of the user, such as a swimsuit, a surf suit, etc.

These and other objects, advantages and features of the invention will become apparent upon review of the following specification in conjunction with the drawings.

BRIEF DESCRIPTION OF THE DRAWINGS

To complement the description that is being made and for the purpose of helping to better understand the features of the invention according to a preferred practical embodiment thereof, a set of drawings is attached an integral part of the description, in which the following is depicted in an illustrative and non-limiting manner.

DESCRIPTION OF THE PREFERRED EMBODIMENTS

Some preferred embodiments are described below in reference to the aforementioned drawings without limiting or reducing the scope of protection of the present invention.

Figure 1:
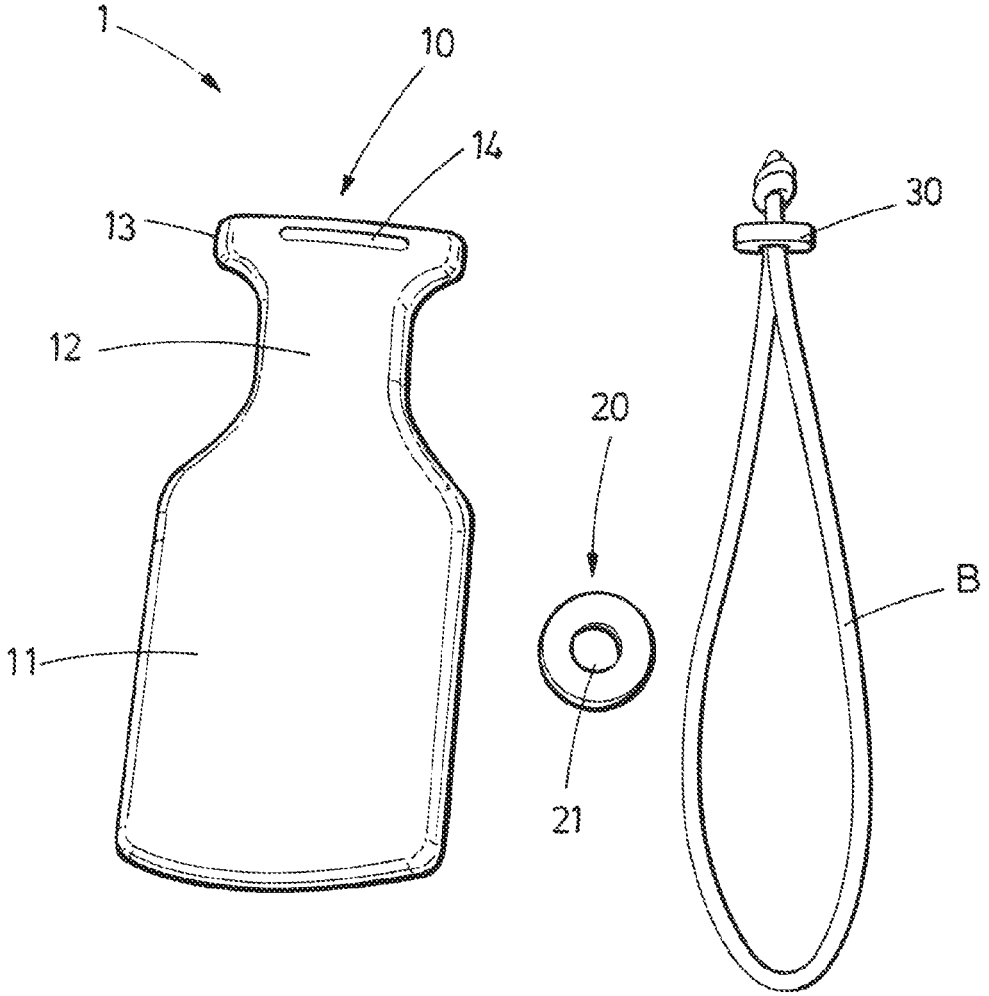
FIG. 1 shows a general view in which the elements making up a sealing device in accordance with the present invention can be seen.
Figure 2A:
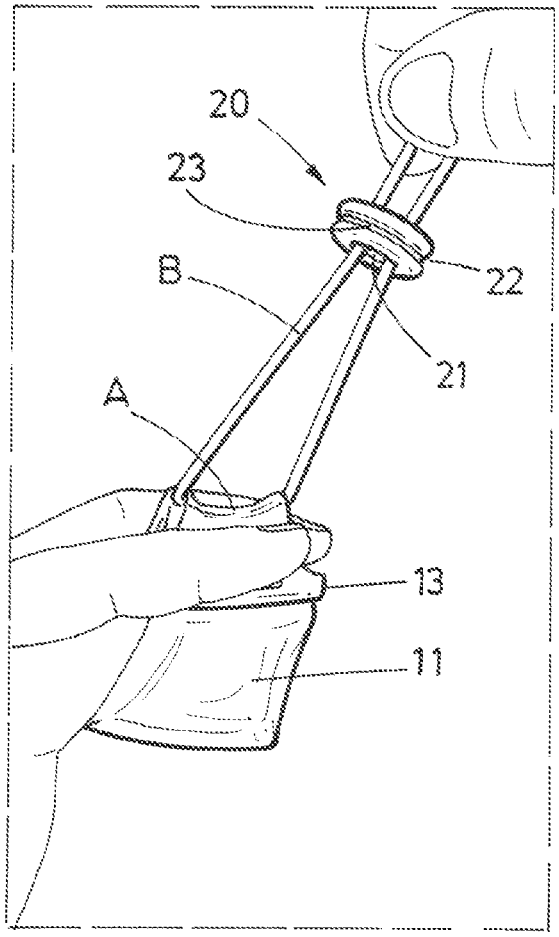
FIGS. 2A and 2B show the device of the invention being handled to achieve optimum hermetic watertight sealing.
Figure 2B:
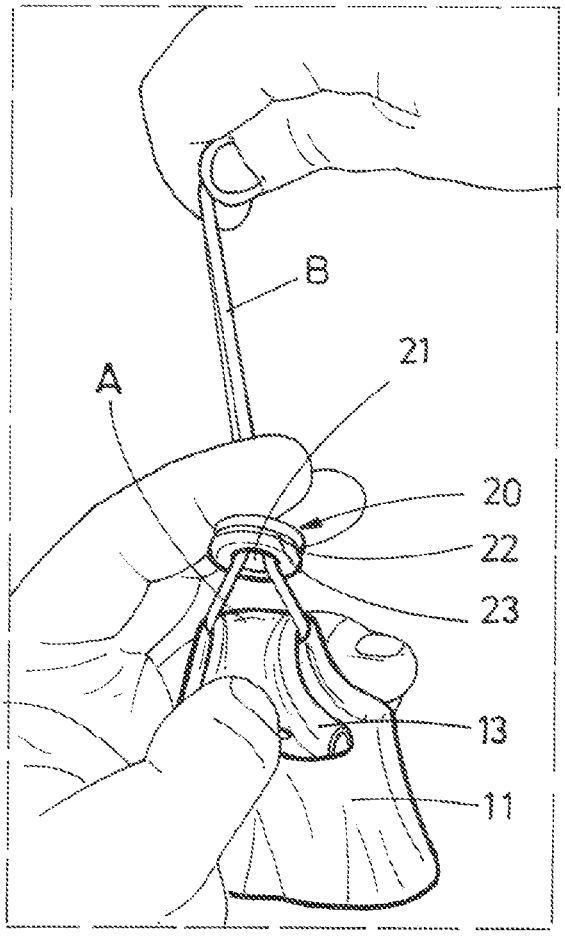
Figure 3:
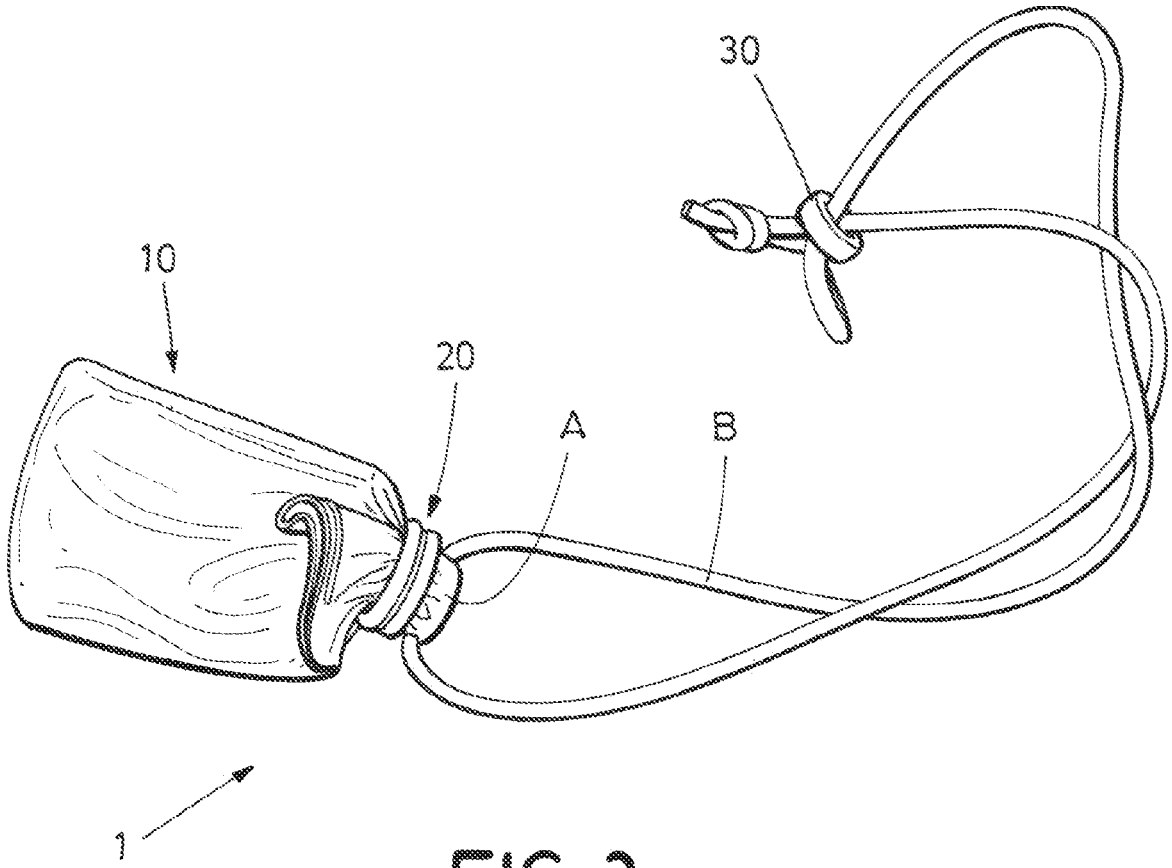
FIG. 3 shows a perspective view of the device in the final sealed position.

A view of the different elements making up the sealing device 1 can be seen in FIG. 1, the device comprising in a first embodiment:

- a bag 10 made of a deformable and waterproof elastic material, in turn comprising a main body 11, a neck 12, and an opening 13 through which an object can be inserted;
- a main ring 20 likewise made of a deformable and waterproof elastic material, and having a central hole 21;
- a band B which, in the embodiment of FIGS. 1 to 3, is part of the sealing device 1 itself, with the ends thereof joined to one another forming a loop, a noose, or a closed segment of the band B; and
- an adjustment part 30 that can slide through the band B for adjusting the length of the band B and fixing same to an extremity or part of the body of the user carrying the device, such as the wrist, neck, or ankle.

This adjustment part 30 opens up a wide range possibilities for the user to place the sealing device 1 where it suits him/her most, according to his/her preferences in terms of comfort and/or type of sports he/she practices, given that certain areas of his/her body may be more prone to sustaining mild frictions (abrasions or rubbing) or impacts.

Figure 4A:
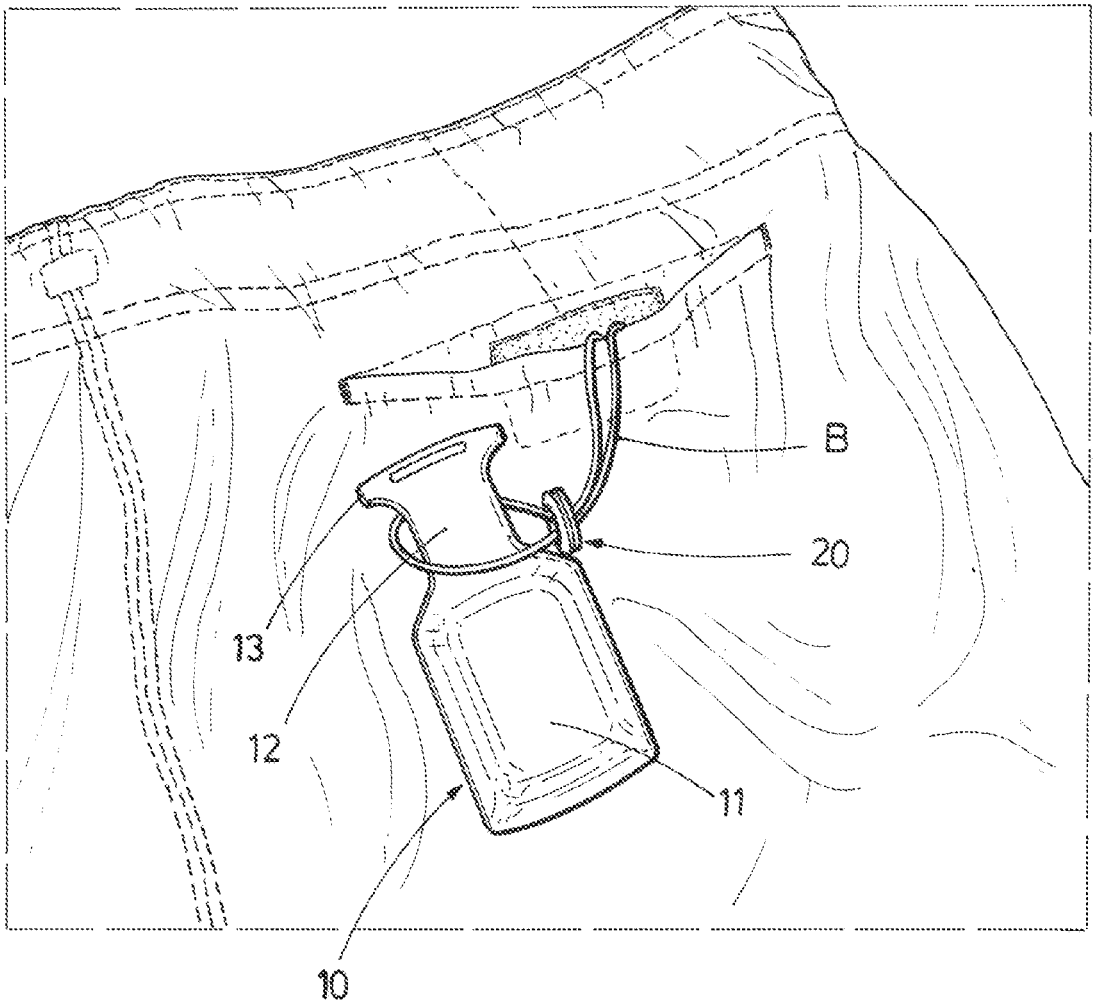
FIGS. 4A and 4B show another embodiment of a sealing device of the present invention, before and after the final sealing, respectively, in this case the band being a strap incorporated in the actual swimsuit of the user.
Figure 4B:
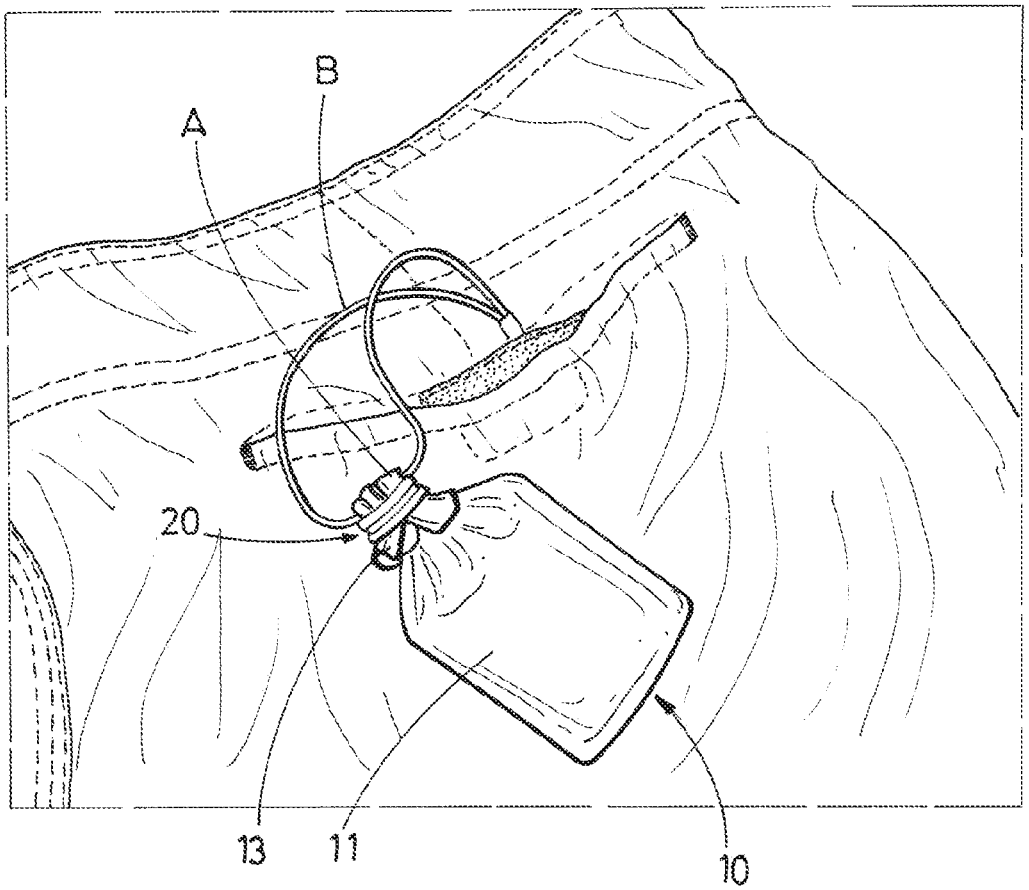

Moreover, according to a second embodiment shown in FIGS. 4A and 4B, the band B is a strap or cord incorporated in the actual clothing of the user, in this case included in one of the pockets of the swimsuit.

Therefore, as observed in both embodiments of FIGS. 3 and 4B, in the final sealed position of the device, the neck 12 of the bag 10 has a fold A in a position inserted into the central hole 21 of the main ring 20, with the band B being retained between the fold A on the neck 12 and the main ring 20, thereby assuring a completely hermetic and watertight sealing.

More specifically, the opening 13 has gripping element or holding means to favor gripping the bag 10, which gripping element or holding means comprise a protuberance 14, clearly shown in FIG. 1, arranged in the proximities of the upper edge of the opening 13, parallel to the edge. As mentioned, these holding means facilitate the gripping and handling of the sealing device 1, and in addition to preventing it from slipping, they also act as a stop element for the main ring 20.

As shown in FIGS. 1 and 4A, the neck 12 is narrower than the main body 11 and the opening 13. This allows preventing the object housed inside the main body 11 from readily coming out of the body since the lower walls of the neck 12 act as a barrier, while at the same time constituting an additional safety element, preventing the main ring 20 from accidentally coming loose or out in the final sealed position, as shown in FIGS. 3 and 4B.

Moreover, the possibility of the main body 11 of the bag 10 being able to have ribs or textured surfaces located on the inner faces of the main body 11 has been envisaged. These textured surfaces favor fixed and stable positioning of the object to be kept inside the main body 11, thereby minimizing possible movements or sliding thereof.

In the embodiment shown in FIGS. 2A and 2B, it can be seen that the main ring 20 has an intermediate annular recess 22 in which a secondary ring 23 is installed. The robustness and safety of the sealing device 1 against the possibility of the bag 10 slipping or breaking free are thereby increased.

Moreover, in the first embodiment the main ring 20 and the secondary ring 23 are made of a different material, such that the material of the secondary ring 23 has a greater rigidity with respect to the material of the main ring 20, thereby achieving a stronger, more secure sealing, if possible, by increasing the structural rigidity thereof. Nevertheless, it has been envisaged that the main ring 20 and the secondary ring 23 may be made of one and the same material.

As shown in FIGS. 2A and 2B, the central hole 21 of the main ring 20 has a diameter equal to or greater than twice the thickness of the band B. This thereby allows smoothly introducing the loop or noose of the band B through the central hole 21 of the main ring 20. Specifically, these FIGS. 2A, 2B would represent phases e) and f) of the method for use described above, namely: e) making a fold A on the neck 12 of the bag 10 retaining the loop of the band B; f) sliding the main ring 20 towards the neck 12 of the bag 10.

According to the described embodiments, both the bag 10 and the main ring 20 are made of silicone, although it will be appreciated that they can nevertheless be formed by other materials exhibiting similar properties in terms of elasticity, waterproofness, and deformation, such as rubber, polyurethane, etc.

Finally, some of the improvements and advantages obtained by means of the sealing device 1 herein described include:

- A simple, quick, and convenient solution for safely keeping all types of small size personal objects and articles in a watertight manner, achieving a hermetic sealing that blocks the passage of any fluid into same.
- Adaptation of the bag 10 to the actual shape of the object to be kept, which favors the portability of the sealing device 1.
- Increased sealing safety while practicing sports, without sharp edges, lids, or rigid parts that may cause injury to the user carrying the device.
- It provides buoyancy, such that such that in the event of the sealing device 1 falling into or being lost in the water, it would not sink, but rather float on the surface of the water for quick identification and locating.
- Low production cost of the sealing device 1, without fixing elements or complex opening and sealing mechanisms to be assembled or mounted.

It will be appreciated that the invention is not limited to the embodiment(s) described herein, but can be amended or modified without departing from the scope of the present invention, which his intended to be limited only by the scope of the appended claims as interpreted according to the principles of patent law including the doctrine of equivalents.

The invention claimed is:

1. A portable, watertight sealing device for use when practicing water and/or underwater sports, said sealing device comprising:

- a bag made of a deformable and waterproof elastic material, the bag comprising a main body, a neck, the neck defining an opening through which an object can be inserted; and
- a main ring made of a deformable and waterproof elastic material, the main ring defining a central hole;
- wherein in a sealed position of the device, the neck of the bag has a fold in a position inserted into the central hole of the main ring, with a band being retained between the fold on the neck and the main ring.

2. The sealing device according to claim 1, wherein the neck comprises a gripping element to facilitate gripping the bag.

3. The sealing device according to claim 2, wherein the gripping element comprises at least one protuberance arranged in proximity to the upper edge of the opening, parallel to the edge.

4. The sealing device according to claim 1, wherein the neck is narrower than the main body and the opening.

5. The sealing device according to claim 1, wherein the main ring has an intermediate annular recess in which a secondary ring is installed.

6. The sealing device according to claim 5, wherein the main ring and the secondary ring are made of the same material.

7. The sealing device according to claim 5, wherein the main ring and the secondary ring are made of a different material, such that the material of the secondary ring has a greater rigidity with respect to the material of the main ring.

8. The sealing device according to claim 1, wherein both the bag and the main ring are made of silicone, rubber, or polyurethane.

9. The sealing device according to claim 1, wherein the central hole of the main ring has a diameter equal to or greater than twice the thickness of the band.

10. The sealing device according to claim 1, further comprising an adjustment part which is slidable through the band for adjusting the length of the band and fixing the band to an extremity or part of the body of the user carrying the device, such as the wrist, neck, or ankle.

11. The portable, watertight sealing device according to claim 1, wherein the band is part of the sealing device, with the ends of the band joined to one another forming a loop.

12. The portable, watertight sealing device according to claim 1, wherein the band is a strap incorporated in the clothing of the user carrying the device.

13. A method for use of the sealing device of claim 1, the method comprising:

a) inserting an object for keeping into the bag;
b) joining the two ends of the band to form a loop;
c) inserting the loop of the band into the central hole of the ring;
d) passing the loop of the band around the neck of the bag;
e) making a fold on the neck of the bag retaining the loop of the band;
f) sliding the ring towards the neck of the bag; and
g) pulling the band until the fold on the neck goes through the central hole of the ring, with the band being retained between the fold on the neck and the main ring itself.

14. The method according to claim 13, wherein step b) is not performed when the band is a strap incorporated in the clothing of the user carrying the device.

* * * * *